United States Patent [19]

Miyakawa et al.

[11] 4,315,064

[45] Feb. 9, 1982

[54] ELECTROSTATIC PHOTOGRAPHIC COPYING PROCESS

[75] Inventors: Nobuhiro Miyakawa, Kobe; Takashi Teshima, Amagasaki, both of Japan

[73] Assignee: Mita Industrial Company Limited, Osaka, Japan

[21] Appl. No.: 98,215

[22] Filed: Nov. 28, 1979

[30] Foreign Application Priority Data

Nov. 28, 1978 [JP] Japan ..... 53/145967

[51] Int. Cl.[3] ..... G03G 13/09

[52] U.S. Cl. ..... 430/122; 430/107; 430/126; 430/111; 430/903

[58] Field of Search ..... 430/122, 107, 903; 118/657, 658

[56] References Cited

U.S. PATENT DOCUMENTS

| | | | |
|---|---|---|---|
| 3,239,465 | 3/1966 | Rheinfrank | 430/903 |
| 3,345,294 | 10/1967 | Cooper | 430/903 |
| 3,697,268 | 10/1972 | Ohta | 430/107 |
| 3,901,695 | 8/1975 | Shelffo | 430/122 |
| 3,965,022 | 6/1976 | Strong | 430/109 |
| 4,102,305 | 7/1978 | Schwarz | 118/658 X |
| 4,121,931 | 10/1978 | Nelson | 118/657 X |
| 4,146,494 | 3/1979 | Hectors et al. | 430/107 |
| 4,175,962 | 11/1979 | Sadamatsu | 430/109 |
| 4,187,330 | 2/1980 | Harada | 430/122 |
| 4,192,902 | 3/1980 | Lu | 430/107 |

FOREIGN PATENT DOCUMENTS

| | | | |
|---|---|---|---|
| 2538112 | 8/1975 | Fed. Rep. of Germany | 430/107 |

*Primary Examiner*—Richard L. Schilling
*Assistant Examiner*—John L. Goodrow
*Attorney, Agent, or Firm*—Sherman & Shalloway

[57] ABSTRACT

Disclosed is an electrostatic photographic copying process comprising causing a substrate carrying an electrostatic latent image thereon to fall in contact with a magnetic brush of a one-component type magnetic developer to effect development of the electrostatic latent image and electrostatically transferring the formed image of the developer onto a transfer sheet, wherein a magnetic developer having an electrostatic capacity of 7.8 to 9.8 PF (picofarad) as determined under conditions of an electrode spacing of 0.65 mm, an electrode sectional area of 1.43 $cm^2$ and an electrode load of 105 $cm^2$ and a dielectric constant of 4 to 5 as determined under the above conditions is used as the one-component type magnetic developer.

11 Claims, 1 Drawing Figure

ELECTROSTATIC PHOTOGRAPHIC COPYING PROCESS

BACKGROUND OF THE INVENTION (1) Field of the Invention

The present invention relates to an improvement in an electrostatic photographic copying process using a one-component type magnetic developer. More particularly, the present invention relates to an improvement for increasing the density and sharpness of a transferred image in the copying process comprising developing a latent image with a one-component type magnetic developer and transferring the resulting image of the developer to a transfer sheet from a substrate to obtain a copied image on the transfer sheet.

(2) Description of the Prior Art

As a developer capable of developing an electrostatic latent image without use of a particular carrier, there has been broadly known a so-called one-component type magnetic developer comprising a finely divided magnetic material incorporated in particles of a developer.

As one type of such one-component magnetic developer, there is known a so-called conductive magnetic developer formed by incorporating a finely divided magnetic material into developer particles to impart a property of being magnetically attracted to the developer particles and distributing a conducting agent such as electrically conductive carbon black on the surfaces of the developer particles (see, for example, the specifications of U.S. Pat. Nos. 3,639,245 and 3,965,022). When this conductive magnetic developer is caused to fall in the form of a magnetic brush in contact with an electrostatic latent image-carrying substrate to effect development of the electrostatic latent image, an excellent visible image free of so-called edge effect or fog is obtained. However, it is known that serious problems are caused when the image of this developer is transferred from the substrate to an ordinary transfer sheet. More specifically, as disclosed in Japanese patent application Laid-Open Specification No. 117435/75, when the specific resistance of a transfer sheet used is lower than $3\times10^{13}$ Ω-cm as in case of ordinary plain paper, broadening of contours or reduction of the transfer efficiency is caused by scattering of the developer particles at the transfer step. This defect can be moderated to some extent by coating a highly electrically resistant resin, wax or oil on the toner-receiving face of a transfer sheet, but this improving effect is relatively low under high humidity conditions. Furthermore, the cost of transfer sheets is increased by coating of the above-mentioned resin, wax or oil and another defect of reduction of the touch is caused.

As another type of the one-component magnetic developer, there is known a non-conductive one-component magnetic developer comprising particles of a homogeneous mixture of a finely divided magnetic material and an electricity-detecting binder. For example, the specification of U.S. Pat. No. 3,645,770 discloses an electrostatic photographic copying process comprises charging a magnetic brush (layer) of the above-mentioned non-conductive magnetic developer with a polarity reverse to that of an electrostatic latent image to be developed by corona discharge, causing the charged developer to fall in contact with an electrostatic latent image-carrying substrate to develop the latent image and transferring the formed image of the developer to a transfer sheet. This process is advantageous in that a transfer image can be formed on so-called plain paper. However, it is difficult to uniformly charge the magnetic brush of the non-conductive magnetic developer to the deep root thereof and therefore, it is difficult to form an image having a sufficiently high density. Furthermore, since a corona discharge mechanism has to be disposed in a developing zone, this process involves a defect that the structure of the copying apparatus as a whole becomes complicated.

Recently, there have been proposed a process in which development of an electrostatic latent image is performed by utilizing charging of the developer by friction between a non-conductive magnetic developer and the surface of an electrostatic latent image-carrying substrate (see Japanese patent application Laid-Open Specification No. 62638/75) and a process in which development is performed by utilizing dielectric polarization of a non-conductive magnetic developer (see Japanese patent application Laid-Open Specification No. 133026/76).

In the former process, it is necessary to control developing conditions strictly, and if the development conditions are not strictly controlled, fogging is caused in a non-image area (especially conspicuous when the degree of the mutual contact between the surface of the photosensitive material and the tops of spikes of magnetic toner particles is high), and fixation of magnetic toner particles to a developing sleeve and blocking of magnetic toner particles are readily caused and this trouble is especially conspicuous when reproduction is carried out continuously.

In the latter process, the problem of fogging is not caused, but since a visible image is formed by applying to an electrostatic latent image a developing charge by the dielectric polarizing effect induced by the magnetic toner, a low voltage area of the electrostatic latent image is not advantageously developed. Accordingly, a low density portion of the original is not effectively reproduced and formation of a print of a half-tone image is difficult.

Furthermore, both of these two processes are defective in that obtained prints are inferior in the image sharpness, and when a p-type photosensitive material such as selenium is used for a photosensitive plate, images having a high density can hardly be formed according to these processes.

SUMMARY OF THE INVENTION

We found that the density of an image formed with the use of a one-component type developer is remarkably influenced by the electrostatic characteristics of developer particles rather than by the developing process adopted and that when a one-component type developer having the electrostatic capacity and dielectric constant quite different from those of conventional magnetic developers is used for development of electrostatic latent images and transfer of developed images, the density, sharpness and clearness can be remarkably improved in the obtained transferred images.

It is therefore a primary object of the present invention to provide an electrostatic photographic copying process which can form on a transfer sheet of plain paper a transferred image having a high density and being excellent in sharpness, clearness and half-tone reproducing capacity.

Another object of the present invention is to provide an electrostatic photographic copying process which makes it possible to perform the reproduction operation continuously for a long time without damaging an electrostatic latent image-carrying substrate, especially the surface of a photosensitive layer, and without provision of any particular accessory equipment for development with a one-component type magnetic developer, and which allows the use of uncoated plain paper as a transfer sheet.

In accordance with the present invention, there is provided an electrostatic photographic copying process comprising causing a substrate carrying an electrostatic latent image thereon to fall in contact with a magnetic brush of a one-component type magnetic developer to effect development of the electrostatic latent image and electrostatically transferring the formed image of the developer onto a transfer sheet, wherein a magnetic developer having an electrostatic capacity of 7.8 to 9.8 PF (picofarad) as determined under conditions of an electrode spacing of 0.65 mm, an electrode sectional area of 1.43 $cm^2$ and an electrode load of 105 $g/cm^2$ and a dielectric constant of 4 to 5 as determined under the above conditions is used as the one-component type magnetic developer.

DETAILED DESCRIPTION OF THE PREFERRED EMBODIMENTS

Figure 1:
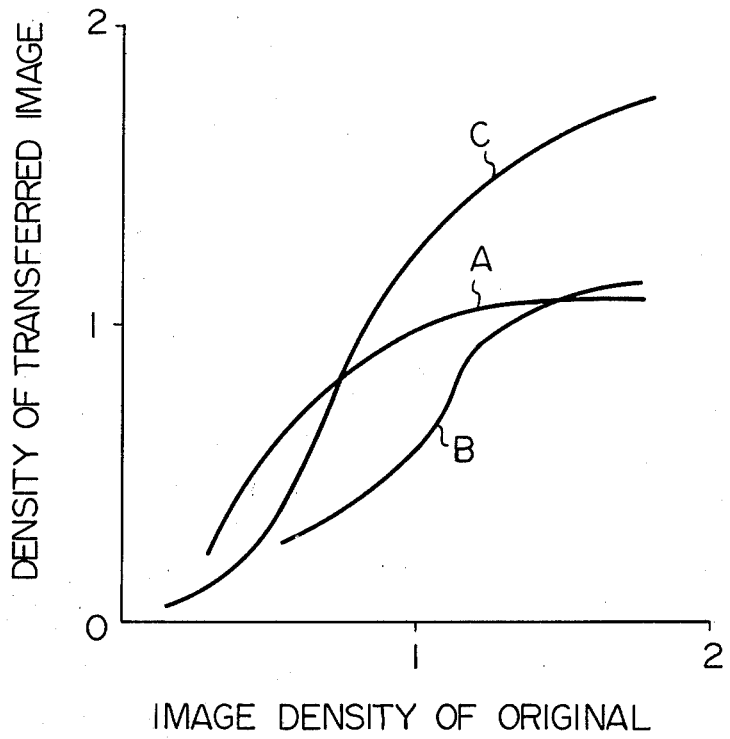
FIG. 1 illustrates relations between the density of the original and the density of the transferred image, observed with respect to various developers.

When a magnetic brush (developer particles) of a one-component type magnetic developer is caused to fall in contact with the surface of an electrostatic latent image-carrying substrate, the electrostatic attracting force (coulomb force) caused between the developer particles and the electrostatic latent image and the magnetic attracting force caused between the developer particles and the magnetic brush-forming magnet (developing sleeve) are ordinarily imposed on individual developer particles. Developer particles on which the coulomb force is larger are attracted to the electrostatic latent image, and developer particles on which the magnetic attracting force is larger are attracted to the developing sleeve. Accordingly, development is conducted depending on the charge of the electrostatic latent image.

One of the important features of the present invention resides in the finding of the phenomenon that the quantity of developer particles attracted to the electrostatic latent image of a certain charge is increased as the electrostatic capacity of the developer particles is small and this phenomenon is utilized for magnetic brush development.

More specifically, when the one-component type magnetic developer of the present invention is caused to fall in the form of a magnetic brush in contact with the surface of an electrostatic image-carrying substrate, since the electrostatic capacity of the developer particles is small, the quantity of the developer particles attracted to the electrostatic latent image is increased and, therefore, a developed image having a high density can be formed and at the transfer step, a transfer image can be formed at a high transfer efficiency.

Moreover, since the dielectric constant of the developer of the present invention is low, individual developer particles can be charged very easily, and since the electrostatic capacity of the developer particles is small, escape of the applied charge is effectively inhibited. These advantages are especially increased by incorporating the below-described copolymer having specific composition and molecular weight as the binder medium. Therefore, when the one-component type developer of the present invention is employed, an excellent image can be obtained without any particular care being taken to the developing device or developing zone.

In order to transfer an image of the developer onto plain paper which has not been subjected to any particular treatment, without troubles such as broadening of contours, it is preferred that the volume resistivity of the developer as determined under the same conditions as the above-mentioned conditions adopted for determination of the electrostatic capacity and dielectric constant be at least $5\times10^{13}$ Ω-cm, especially at least $1\times10^{14}$ Ω-cm.

In any of the conventional one-component type magnetic developers, the electrostatic capacity and dielectric constant as determined under the above conditions are outside the ranges specified in the present invention, and these conventional magnetic developers are still insufficient in prevention of fogging or improvement of the density in transferred images.

In contrast, when the one-component type magnetic developer having specific electrostatic capacity and dielectric constant is used according to the present invention, as demonstrated in Examples given hereinafter, the density of the transferred image can be increased by at least 1.8 times and reproduction of the half-tone image becomes possible. Furthermore, these advantages can be attained without occurrence of such troubles as contamination of the background (fogging), edge effect and broadening of contours.

In conventional non-conductive magnetic developers, for development of electrostatic latent images, it is indispensable to forcibly charge developer particles from the outside by corona discharge or the like or to frictionally charge the developer by rotating the magnetic brush of the developer in a direction opposite to the moving direction of the substrate to cause strong sliding contact between the developer and substrate. When the developer of the present invention is used, as demonstrated in Examples given hereinafter, such special operation need not be performed and the obtained image excels over images formed according to the conventional techniques. These facts suggest that only if the developer of the present invention is used in the form of a magnetic brush, desired charging can easily be accomplished.

In the one-component type magnetic developer used in the present invention, the above-mentioned electrostatic capacity and dielectric constant are remarkably changed according to the kinds of the finely divided magnetic material and the resin medium in which the magnetic material is dispersed, the content of the magnetic material, the manner of dispersion of the magnetic material and other factors such as developer particle forming conditions, and it is very difficult to define these factors specifically and independently. However, there are certain critical standard requirements to be satisfied for preparing a developer having the above-mentioned characteristic properties. These requirements will now be described.

First of all, it is necessary that the amount of the finely divided magnetic material to be incorporated into the developer should be 45 to 65% by weight, particularly 50 to 60% by weight, based on the total developer. If the amount of the finely divided magnetic material is larger than 65% by weight, both the electrostatic capacity and dielectric constant exceed the ranges specified in the present invention and it is difficult to obtain a transfer image having a high density. When the amount of the finely divided magnetic material is smaller than 45% by weight, it is difficult to impart to the developer a property of being magnetically attracted sufficiently and the electrostatic capacity and dielectric constant are decreased below the ranges specified in the present invention. As a result, the charging tendency is increased and such troubles as fogging and scattering of the developer are readily caused.

As the finely divided magnetic material, there have heretofore been used triiron tetroxide ($Fe_3O_4$), diiron trioxide ($\gamma$-$Fe_2O_3$), zinc iron oxide ($ZnFe_2O_4$), yttrium iron oxide ($Y_2Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). In the present invention, these known magnetic materials may be used singly or in the form of a mixture of two or more of them. Fine powders of triiron tetroxide and diiron trioxide are especially preferred for attaining the objects of the present invention.

Also the particle size of the finely divided magnetic material has influences on the electrostatic characteristics of the developer. When the particle size of the finely divided magnetic material is too large, the powder of the magnetic material tends to be exposed to the surfaces of the developer particles, and if the particle size of the finely divided magnetic material is too small, the finely divided magnetic material tends to form a so-called chain structure in the developer particles and the electrostatic capacity and dielectric constant are increased. In view of the foregoing, it is preferred to use a finely divided magnetic material having such a particle size distribution that particles having a size larger than 0.5$\mu$ occupy less than 20% of the total particles and particles having a size smaller than 0.3$\mu$ occupy less than 20% of the total particles. When the finely divided magnetic material is subjected to a coating treatment described in detail hereinafter, it is possible to use a magnetic material having a particle size distribution other than the above-mentioned particle size distribution.

In order to maintain the electrostatic capacity and dielectric constant of the developer within the above-mentioned ranges, a certain resin should be selected and used as the resin medium. In accordance with one preferred embodiment of the present invention, a copolymer comprising (a) at least one aromatic vinyl monomer and (b) at least one mono- or di-ethylenically unsaturated monomer other than the aromatic vinyl monomer is used as the resin medium.

As the aromatic vinyl monomer (a), there are preferably employed monomers represented by the following general formula:

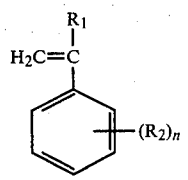

wherein $R_1$ stands for a hydrogen atom, a lower alkyl group having 1 to 4 carbon atoms or a halogen atom, $R_2$ stands for a substituent such as a lower alkyl group or a halogen atom, and n is an integer of up to 2, such as styrene, vinyltoluene, $\alpha$-methylstyrene, $\alpha$-chlorostyrene and vinylxylene, and vinylnaphthalene. Among these monomers, styrene and vinyltoluene are preferred.

As the monomer (b) other than the aromatic vinyl monomer, there are preferably employed acrylic monomers represented by the following general formula:

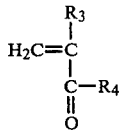

wherein $R_3$ stands for a hydrogen atom or a lower alkyl group, and $R_4$ stands for a hydroxyl group, an alkoxy group, a hydroxyalkoxy group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide, and conjugated diolefin type monomers represented by the following general formula:

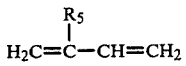

wherein $R_5$ stands for a hydrogen atom, a lower alkyl group or a chlorine atom, such as butadiene, isoprene and chloropene.

Furthermore, there may be used other ethylenically unsaturated carboxylic acids such as maleic anhydride, fumaric acid, crotonic acid and itaconic acid, esters thereof, vinyl esters such as vinyl acetate, vinyl pyridine, vinyl pyrrolidone, vinyl ethers, acrylonitrile, vinyl chloride and vinylidene chloride.

A resin medium especially suitable for attaining the objects of the present invention is a copolymer comprising (a) at least one aromatic vinyl monomer and (b) at least one member selected from acrylic monomers and conjugated diolefins.

In the binder medium that is used in the present invention, if the content of the aromatic vinyl monomer component is 20 to 95% by weight, particularly 45 to 93% by weight, based on the total binder medium, the objects of the present invention can be attained very advantageously.

Furthermore, in view of the fixing property, it is preferred that the molecular weight of the resin medium be in the range of from 70,000 to 200,000.

It is preferred that the resin medium be used in an amount of 30 to 120% by weight, particluarly 40 to 100% by weight, based on the finely divided magnetic material.

As another factor important for maintaining the electrostatic capacity and dielectric constant of the developer within the above-mentioned range, there can be mentioned the state or manner of dispersion of the finely divided magnetic material in the developer particles. As pointed out hereinbefore, it is important that the finely divided magnetic material should be dispersed in the particulate form uniformly in the resin medium. When the finely divided magnetic material is kneaded with the resin medium while the resin medium is softened or molten, the dielectric constant of the formed developer particles is changed according to the kneading time or the degree of kneading, and it has been confirmed that when the kneading operation is conducted for a long time, the dielectric constant is reduced.

Therefore, when the developer used in the present invention is prepared according to the melt-kneading method, it is important that the kneading conditions should be selected so that the dielectric constant is within the above-mentioned range.

In order to disperse the finely divided magnetic material in the particulate form uniformly in the resin medium, it is preferred that the particle size distribution of the finely divided magnetic material be within the above-mentioned range. In the present invention, this uniform dispersion of the finely divided magnetic material can also be attained by coating the finely divided magnetic material with a fatty acid, a resin acid or a metal soap thereof or a surface active agent in an amount of 0.1 to 30% by weight based on the magnetic material.

Known auxiliary components for developers may be added to the developer components according to known recipes prior to kneading and granulation of the developer components. For example, in order to improve the hue of the developer, one or more of pigments such as carbon black and dyes such as Nigrosine may be added in an amount of 0.5 to 5% by weight based on the entire developer. Furthermore, in order to extend the developer, a filler such as calcium carbonate or finely divided silica may be incorporated in an amount of up to 20% by weight based on the total developer. In order to control the charge of the developer, an oil-soluble dye such as Oil Black or Oil blue may be added in an amount of 0.1 to 3% by weight based on the entire developer. When the developer is used for the fixing method using a heating roll, an offset preventing agent such as a silicone oil, a low-molecular-weight olefin resin or a wax may be used in an amount of 2 to 15% by weight. When the developer is used for the fixing method using a pressing roll, a fixing property-improving agent such as paraffin wax, an animal or vegetable wax, a higher fatty acid or a fatty acid amide may be added in the amount of 5 to 30% by weight based on the total developer. Furthermore, a flow-improving agent such as finely divided polytetrafluoroethylene may be added in an amount of 0.1 to 1.5% by weight based on the total developer so as to prevent cohesion of the developer particles and improve the flowability of the developer particles.

In the present invention, in order to obtain a developer having the above-mentioned specific characteristics, it is important that formation of developer particles should be performed according to the so-called pulverization method. Spherical developer particles prepared according to the spray dry method or heat rounding method do not have the above-mentioned electric characteristics.

For information of developer particles, the kneaded composition of the developer components is cooled and pulverized, and the resulting particles are classified according to need. Of course, mechanical high-speed agitation may be performed to remove angular portions from particles having an indeterminate shape.

It is ordinarily preferred that the size of the developer particles be in the range of 5 to 35 microns, though the preferred particle size differs to some extent depending on the desired resolving power. When the developer used in the present invention is composed of particles having an indeterminate shape, which are prepared by the kneading-pulverization method, the transfer efficiency is further increased and the image sharpness is further improved.

In the electrostatic photographic reproduction process of the present invention, an electrostatic latent image is formed according to any of known methods. For example, an electrostatic latent image can be formed by uniformly charging a photoconductive layer on an electrically conductive substrate and subjecting the charged photoconductive layer to imagewise exposure.

The surface of the substrate having the so formed electrostatic latent image is caused to fall in contact with a magnetic brush of the above-mentioned one-component type magnetic developer, whereby a visible image of the developer is formed.

Then, the image of the developer formed on the substrate is caused to fall in contact with a transfer sheet and corona discharge of the same polarity as that of the electrostatic latent image is effected from the back of the transfer sheet, whereby the image of the developer is transferred onto the transfer sheet.

It has been found that the one-component type magnetic developer used in the present invention shows reproduction characteristics quite different from those of the known conventional one-component type magnetic developers in the above-mentioned electrostatic photographic reproduction process.

FIG. 1 of the accompanying drawing shows the relation between the density of an image of the original and the density of a copied image on a transfer sheet. This relation observed when frictional charge caused between a developer and a substrate is utilized according to the process disclosed in Japanese Patent Application Laid-Open Specification No. 62638/75 is plotted to obtain a curve A in FIG. 1. This curve is upwardly convex and is saturated at a low density. The above relation observed when dielectric polarization of a developer is utilized according to the teaching of Japanese Patent Application Laid-Open Specification No. 133026/76 is plotted to obtain a curve B. This curve is upwardly concave and is saturated at a low density. From these curves A and B, it is seen that in each of these two conventional developers, attainment of a linear proportional relation in a broad region cannot be expected and it is difficult to reproduce a half-tone image or obtain a transferred image having a high density. In contrast, when a developer satisfying the requirements of the electrostatic capacity and dielectric constant specified in the present invention is used, in a curve C formed by plotting the density of the original image and the density of the transferred image, a substantially linear porportional relation is manifested in a relatively broad region. Thus, it will readily be understood that when the developer of the present invention is used, it is possible to reproduce a half-tone image or obtain a transferred image having a high density.

In the present invention, fixation of the transferred image can be performed according to any of known methods such as the method using a heating roller, the method using a flash lamp and the method using a pressing roller, and a suitable method is selected according to the kind of the developer.

The developing process of the present invention is especially suitable for development of a positively charged latent image on a p-type photosensitive plate such as a selenium photosensitive plate or an organic photoconductor photosensitive plate. A conventional one-component type magnetic developer can be used for development in a photosensitive plate carrying a negatively charged latent image, but when it is used for development of a positively charged latent image on a p-type photosensitive plate, no satisfactory results can be obtained. In contrast, according to the present invention, excellent effects can be attained in development of positively charged latent images and transfer of developed images.

The present invention will now be described in detail with reference to the following Examples that by no means limit the scope of the invention.

EXAMPLE 1

A magnetic toner (toner A) was prepared according to procedure described in Example 5 of Japanese Patent Application Laid-Open Specification No. 62638/75. The composition of this toner was as follows:

| | | |
|---|---|---|
| Piccolastic E-125 (styrene homopolymer resin having a molecular weight of 6000 and manufactured by Esso Standard) | 25 | parts |
| Beckaside 1110 (maleic acid-modified natural resin manufactured by Dainippon Ink Kagaku) | 15 | parts |
| Magnetic Iron Oxide BL-500 (manufactured by Titan Kogyo) | 60 | parts |
| Orazole Black P (manufactured by Ciba) | 2.5 | parts |

A magnetic toner (toner B) was prepared according to procedures described in Experiment 2 of Japanese Patent Application Laid-Open Specification No. 133026/76. This toner comprised 30 parts of a styrene resin, 66 parts of magnetic particles having a particle size of 0.05 to 0.1$\mu$ and 4 parts of stearic acid.

A toner of the present invention was prepared in the following manner.

First, 55 parts of magnetite ($Fe_3O_4$, Black Iron BM manufactured by Toyo Shikiso Kogyo) and 45 parts of a vinyltoluene/2-ethylhexyl acrylate copolymer (molar ratio=17/3; weight average molecular weight=83,000) were melt-kneaded by using a two-roll mill, and the kneaded mixture was naturally cooled and roughly pulverized by a cutting mill to form coarse particles having a size of 0.5 to 2 mm. Then, the particles were finely pulverized by a jet mill and classified by a zigzag classifier to obtain a magnetic toner having a particle size of 10 to 30$\mu$.

By using the so prepared 3 toners, the copying test was carried out in the following manner.

In a copying machine using a selenium drum as a photosensitive material, the magnetic toner was applied to a developing roller having a magnet built therein through a non-magnetic member, and the distance between the magnetic roller and a spike cutting plate was adjusted to 0.3 mm and the distance between the surface of the photosensitive material and the developing roller was adjusted to 0.5 mm. The developing roller was moved in the same direction as the moving direction of the photosensitive material at a speed 2 times the moving speed of the photosensitive material. Under these conditions, charging, exposure, development and transfer were conducted. High quality paper having a thickness of 80$\mu$ was used as a transfer sheet. Results of the copying test and physical properties of the toners are shown in Table 1. The image density was measured on a solid black portion.

TABLE 1

| Magnetic Toner | Volume Resistivity ($10^{14}\Omega$-cm) | Electrostatic Capacity (PF) | Dielectric Constant | Image Density | Sharpness (image quality) |
|---|---|---|---|---|---|
| A | 6.4 | 15.1 | 7.74 | 0.76 | blurring, Δ |
| B | 2.8 | 10.4 | 5.33 | 0.83 | blurring, Δ |
| magnetic toner of present invention | 4.3 | 8.9 | 4.56 | 1.52 | no blurring, ◎ |

Note
Δ: very clear image
◎: broadening by blurring

In order to improve the image density in the case of the toners A and B, the distance between the surface of the photosensitive material and the developing roller was shortened. However, fogging or blocking of the toner was caused, and continuous reproduction was impossible. When the toner of the present invention was used, an image having a high density and being free of fogging or edge effect was obtained.

At the copying test using a grey scale of Kodak Co., 5 stages were confirmed in the toner A and 4 stages were confirmed in the toner B. In contrast, 9 stages were confirmed in the toner of the present invention.

EXAMPLE 2

A magnetic toner (toner D) was prepared according to procedures described in Example 2 of Japanese Patent Application Laid-Open Specification No. 92137/75. The composition of this toner was as follows:

| | | |
|---|---|---|
| Pliolite VT (vinyltoluene/butadiene copolymer having a weight average molecular weight of 152,000 and manufactured by Goodyear) | 100 | parts |
| Orazole Black 2RG (manufactured by Ciba) | 1 | part |
| Carbon Black #44 (manufactured by Mitsubishi Kasei) | 3 | parts |
| EPT 500 ($Fe_3O_4$ manufactured by Toda Kogyo) | 30 | parts |

A toner of the present invention was prepared in the same manner as described in Example 1 by using 60 parts of magnetic ($Fe_3O_4$, Black Iron BL-500 manufactured by Titan Kogyo) and 40 parts of a vinyltoluene/-butadiene copolymer (molar ratio=6/1, weight average molecular weight=78,000). The copying test was carried out in the same manner as described in Example 1 by using the so prepared 2 toners. Obtained results and physical properties of the toners are shown in Table 2.

TABLE 2

| | Magnetic Toner D | Toner of Present Invention |
|---|---|---|
| Volume Resistivity | $5.2 \times 10^{14}$ Ω-cm | $3.9 \times 10^{14}$ Ω-cm |
| Electrostatic Capacity (PF) | 7.7 | 9.0 |
| Dielectric Constant | 3.95 | 4.62 |
| Image Density | 1.50 | 1.49 |
| Sharpness (image quality) | thickening of printed letters, difficult to read, Δ | no blurring, |
| Fog Density | 0.32 | no fog |

Although the density of the image formed by using the toner D was high, fogging was caused. When the distance between the surface of the photosensitive material and the developing roller was broadened by 0.1 mm so as to prevent occurrence of fogging, the image density was reduced to 0.65 though occurrence of fogging was prevented. Furthermore, the magnetic toner D was poor in the cleaning property and was left adherent on the surface of the selenium drum. The remaining toner on the drum could be removed when the brushing operation was conducted several times.

EXAMPLE 3

Magnetic toners were prepared from magnetic ($Fe_3O_4$, BL-500 manufactured by Titan Kogyo) and a thermoplastic resin (styrene/2-ethylhexyl acrylate copolymer, molar ratio=17/3, weight average molecular weight=73,000). The composition and the preparation process are described below.

Toner (1): 60 parts of magnetic and 40 parts of resin
Toner (2): 50 parts of magnetic and 50 parts of resin
Toner (3): 55 parts of magnetic and 45 parts of resin The toners (1) and (2) were prepared according to the spray-dry method using a toluene-acetone mixed solvent and they were composed of spherical particles having a particle size region of 10 to 30μ.

The toner (3) was prepared according to the melt-kneading method using a 2-roll mill and the kneaded mixture was cooled and pulverized. The obtained toner was composed of particles having an indeterminate shape and a particle size region of 10 to 30μ.

In the same manner as described in Example 1, the copying test was carried out. Obtained results and physical properties of the magnetic toners are shown in Table 3.

TABLE 3

| Magnetic Toner | Volume Resistivity (Ω-cm) | Electrostatic Capacity (PF) | Dielectric Constant | Image Density | Sharpness (image quality) |
|---|---|---|---|---|---|
| (1) | $1.0 \times 10^{14}$ | 12.6 | 6.46 | 1.42 | blurring, Δ |
| (2) | $3.5 \times 10^{14}$ | 11.1 | 5.69 | 1.48 | blurring, Δ |
| (3) | $6.8 \times 10^{14}$ | 8.5 | 4.36 | 1.55 | no blurring, ◎ |

Note
Δ: the quality of the transferred image was poor because of cut effects and particulate dots inherent of the spherical toner, and blurring was observed in thin printed letters
◎: good image quality From the results shown in Table 3, it is seen that when the magnetic toner is formed into spherical particles, the electrostatic capacity and dielectric constant tend to increase, and in the transferred toner image, blurring is readily caused because of the spherical configuration of the toner particles.

EXAMPLE 4

In the same manner as described in Example 1, magnetic toners having a composition shown below were prepared by using magnetite ($Fe_3O_4$, KN-320 manufactured by Toda Kogyo) and a thermoplastic resin (vinyltoluene/2-ethylhexyl acrylate/butadiene terpolymer, molar ratio=16/1/3, weight average molecular weight=85,500).

Toner (4): 75 parts of magnetite and 25 parts of resin
Toner (5): 65 parts of magnetite and 35 parts of resin
Toner (6): 55 parts of magnetite and 45 parts of resin
Toner (7): 45 parts of magnetite and 55 parts of resin
Toner (8): 35 parts of magnetite and 65 parts of resin The copying test was carried out in the same manner as described in Example 1 by using these toners. Obtained results and physical properties of the toners are shown in Table 4.

TABLE 4

| Magnetic Toner | Volume Resistivity (Ω-cm) | Electrostatic Capacity (PF) | Dielectric Constant | Image Density | Sharpness (image quality) | Fog Density |
|---|---|---|---|---|---|---|
| (4) | $9.0 \times 10^{13}$ | 10.9 | 5.60 | 0.50 | no blurring, Δ | no fog |
| (5) | $1.5 \times 10^{14}$ | 9.32 | 4.78 | 0.81 | no blurring, ○ | no fog |
| (6) | $5.2 \times 10^{14}$ | 8.60 | 4.41 | 1.37 | no blurring, ◎ | no fog |
| (7) | $8.3 \times 10^{14}$ | 8.09 | 4.15 | 1.58 | no blurring, ○ | 0.20 |
| (8) | $1.0 \times 10^{15}$ | 7.79 | 3.99 | 1.60 | thickening of letters, Δ | 0.30 |

From the results shown in Table 4, it is seen that good results are obtained when 45 to 65 parts of magnetite and 35 to 55 parts of the resin components are used.

EXAMPLE 5

In the same manner as described in Example 1, a magnetic toner was prepared by using 55 parts of magnetite ($Fe_3O_4$, Black Iron B6 manufactured by Toyo Shikiso), 37.5 parts of a styrene/butadiene copolymer (molar ratio=6/1, weight average molecular weight of 132,000) and 7.5 parts of low-molecular-weight polypropylene (Viscol 550-P manufactured by Sanyo Kasei). The copying test was carried out by using this toner and fixation was carried out by using a heating roll. The obtained image was very sharp and clear and free of fogging or blurring and had a density of 1.64.

The above magnetic toner was characterized by a volume resistivity of $5.8 \times 10^{14}$ Ω-cm, an electrostatic capacity of 9.0 PF and a dielectric constant of 4.62.

What we claim is:

1. An electrostatic photographic copying process comprising causing a substrate carrying an electrostatic latent image thereon to fall in contact with a magnetic brush of a one-component type magnetic developer to effect development of the electrostatic latent image and electrostatically transferring the formed image of the developer onto a transfer sheet, wherein the magnetic developer comprises a resin medium and a finely divided magnetic material dispersed therein, the resin medium comprising a copolymer comprising (a) at least one aromatic vinyl monomer and (b) at least one mono- or di-ethylenically unsaturated monomer other than the aromatic vinyl monomer, the amount of the finely divided magnetic material being 45 to 65% by weight based on the total developer, the amount of said copolymer being 30 to 120% by weight based on the finely divided magnetic material, said magnetic developer being prepared by melt-kneading the mixture of the resin medium and the finely divided magnetic material and cooling the kneaded composition and pulverizing the cooled composition, said magnetic developer having an electrostatic capacity of 7.8 to 9.32 PF (picofarad) as determined under conditions of an electrode spacing of 0.65 mm, an electrode sectional area of 1.43 $cm^2$ and an electrode load of 105 $cm^2$, and a dielectric constant of 4 to 4.78 and a volume resistivity of at least $5\times10^{13}$ Ω-cm, as determined under the above conditions.

2. An electrostatic photographic copying process according to claim 1 wherein the content of the aromatic vinyl monomer in said copolymer is 20 to 95% by weight.

3. An electrostatic photographic copying process according to claim 1 wherein the amount of said copolymer is from 40 to 100% by weight based on the finely divided magnetic material.

4. An electrostatic photographic copying process according to claim 1 wherein the amount of the finely divided magnetic material is in the range of 50 to 60% by weight, based on the total developer.

5. An electrostatic photographic copying process according to claim 1 wherein the finely divided magnetic material has a particle size distribution such that particles having a size larger than 0.5 micron occupy less than 20% of the total particles and particles having a size smaller than 0.3 micron occupy less than 20% of the total particles.

6. An electrostatic photographic copying process according to claim 1 wherein the fine particles of the magnetic material are coated with fatty acid, a resin or a metal salt thereof or a surface-active agent in an amount of 0.1 to 30% by weight, based on the magnetic material.

7. An electrostatic photographic copying process according to claim 1 wherein the size of the magnetic developer particles is in the range of 5 to 35 microns.

8. An electrostatic photographic copying process according to claim 6 wherein said resin medium comprises a copolymer comprising (a) at least one aromatic vinyl monomer selected from compounds represented by the following formula (I):

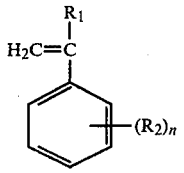

(I)

wherein $R_1$ stands for a hydrogen atom, a lower alkyl group having 1 to 4 carbon atoms or a halogen atom, $R_2$ stands for a lower alkyl group or a halogen atom, and n is an integer of up to 2, or vinylnaphthalene; and (b) at least one mono- or di-ethylenically unsaturated monomer selected from acrylic monomers represented by the following formula (II):

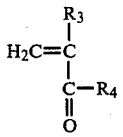

(II)

wherein $R_3$ stands for a hydrogen atom or a lower alkyl group, and $R_4$ stands for a hydroxyl group, an alkoxy group, a hydroxyalkoxy group or an aminoalkoxy group, or conjugated diolefin monomers represented by the following formula (III):

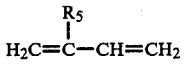

(III)

wherein $R_5$ stands for a hydrogen atom, a lower alkyl group or a chlorine atom.

9. An electrostatic photographic copying process according to claim 8 wherein said resin medium is a copolymer of an aromatic vinyl monomer of formula (I) and an acrylic monomer of formula (II).

10. An electrostatic photographic copying process according to claim 8 wherein said copolymer has a weight average molecular weight in the range of 75,000 to 150,000.

11. An electrostatic photographic copying process according to claim 10 wherein the copolymer comprises from 45 to 93% by weight of the aromatic vinyl monomer (a) based on the total binder medium.

* * * * *